US008167671B2

(12) United States Patent
Stone

(10) Patent No.: US 8,167,671 B2
(45) Date of Patent: May 1, 2012

(54) LOCATOR DEVICE FOR WATER-SKIS OR WATER BOARDS

(76) Inventor: Jennifer Leah Stone, Mill Valley, CA (US)

( * ) Notice: Subject to any disclaimer, the term of this patent is extended or adjusted under 35 U.S.C. 154(b) by 158 days.

(21) Appl. No.: 12/655,332

(22) Filed: Dec. 29, 2009

(65) Prior Publication Data

US 2011/0159754 A1 Jun. 30, 2011

(51) Int. Cl.
*B63B 35/81* (2006.01)
*B63B 35/85* (2006.01)

(52) U.S. Cl. ..... 441/68; 441/70

(58) Field of Classification Search ..... 441/65, 441/68, 70, 73; 280/624
See application file for complete search history.

(56) References Cited

U.S. PATENT DOCUMENTS 2,694,209 A * 11/1954 Lippincott ..... 441/77
2,716,246 A * 8/1955 Billingham ..... 441/70
3,066,326 A 9/1957 Collins
3,031,697 A 9/1959 Klein
3,064,286 A * 11/1962 Hammond ..... 441/72
3,212,113 A 10/1965 Barrett
4,026,236 A 5/1977 Robbins
4,865,572 A * 9/1989 Andes ..... 441/72
4,871,335 A * 10/1989 Grams ..... 441/68
5,514,016 A 5/1996 Larson
5,700,174 A * 12/1997 Churchill et al. ..... 441/65
5,910,034 A * 6/1999 Vukelic et al. ..... 441/70
7,210,975 B1 * 5/2007 Lubinitsky ..... 441/70
7,758,062 B2 * 7/2010 Klubitschko ..... 280/613
2009/0061706 A1 3/2009 Myerscough

FOREIGN PATENT DOCUMENTS

DE 4021900 A1 * 1/1992

* cited by examiner

*Primary Examiner* — Stephen Avila
*Assistant Examiner* — Andrew Polay

(57) ABSTRACT

A water-ski or water board locating device comprised of a buoyant body detachably secured to the top of the ski or board, behind the boot, by means of a base plate and the boot's binding screws. In this position, the device effectively uprights the water-ski or water board when floating unattended. By uprighting the water-ski or water board, the device increases its visibility, aiding in the recovery of the ski or board and increasing its safety as a floating obstacle.

2 Claims, 3 Drawing Sheets

LOCATOR DEVICE FOR WATER-SKIS OR WATER BOARDS

CROSS-REFERENCE TO RELATED APPLICATIONS

None.

FEDERALLY SPONSORED RESEARCH

None.

SEQUENCE LISTING

None.

FIELD OF INVENTION

This invention generally relates to water-skis or water boards, specifically to an uprighting mechanism for easier location of the water-ski or water board. The invention is particularly concerned with the increased visibility, and therefore increased safety and easier retrieval, of a water-ski or water board when detached from a user.

BACKGROUND OF INVENTION

Water-skiing may be generalized as the surface water activity in which a skier balancing on one or two water-skis is towed behind a motor boat. There are various dangers involved with the activity and others involving water boards, some of which are due to the eventual separation of ski, skis, or board and user. A skier may become disconnected with his water-ski or skis intentionally, when electing to drop from two skis down to one ski, or unintentionally, when falling. The maneuver of elective detachment of ski from skier results in an unattended water-ski, floating in open water. Due to the buoyancy distribution of modern water-skis, an unattended ski may rest in one of two positions. The upwards position, in which the bottom of the ski is resting downwards, allows the boot to protrude upward from the surface of the water, resulting in a relatively visible obstacle. More commonly, however, the ski rests in the downward position, in which the boot is submerged and the bottom of the ski rests nearly flush with the surface of the water. In this position, the ski is very difficult to view. During the course of a water-ski, the skier performs maneuvers through a wide lateral range behind the boat and is towed a considerable distance. These large distances may be traveled away from where the water-ski was left behind, creating a low vantage point of the towing boat to the ski. Frequently, the bodies of water on which one might elect to water-ski present conditions such as extremely bright or dark lighting and minor wave actions, which greatly diminish the visibility of an unattended water-ski. This poorly visible resting position a considerable distance away from the skier himself in extremely lit and less than calm conditions creates a situation of drastically decreased visibility, which is hazardous to water-goers and difficult for the retrieval of the water-ski.

BACKGROUND

Prior Art and Advantages

Various devices for locating a water-ski or water board lying idle in a body of water have been proposed in order to increase visibility and safety of the unattended ski or board, most commonly with use of buoyancy providing core materials attached to the ski or board. They fall into three general categories.

The first includes attachments to the water-ski designed to project above the surface of the water. For example, U.S. Pat. No. 3,212,113 is comprised of a ball like buoy attached to the dorsal side of the ski at the stern end that floats above the water when the ski rests slightly submerged. This device, however, is ineffective for modern skis which float at the surface of the water. It also fails to increase the visibility of the water-ski when resting upside down, as the ski often does. U.S. Pat. No. 4,026,236 increases the visibility of the ski by use of two opposing vertical flags with flexible masts clamped to one side of the ski. U.S. Pat. No. 5,514,016 depicts a cylindrical buoy attached by rope and clip to the stern end of the water-ski that trails behind the ski when in use and which floats vertically when at rest. Although the previous two devices effectively protrude out of the water despite the resting position of the ski, they both considerably interfere with the smooth flow of the water along the ski during use.

The second category includes devices for changing the hydrostatics of the water-ski, with use of buoyancy providing core materials attached to the bow of the ski. For example, U.S. Pat. No. 3,031,697 attempts to increase the visibility of the ski by altering the floatation position of the ski by use of an expanded, buoyant bow and weighted stern, causing the bow of the ski to project above the water. U.S. Pat. No. 3,066,326 is comprised of a buoyant sheath that encapsulates the bow end of the ski. These devices have several common drawbacks including altering the normal contour of the ski and increasing drag in the water, both of which undesirably alter the specific way in which the ski planes on the water.

The third category of water-ski locating devices are designed to flip the ski or board into an upright position so that the boot protrudes visibly out of the water. Although uprighting the overturned ski is an effective mode of increasing visibility, the existing uprighting devices have drawbacks. U.S. Pat. No. 4,871,335 suggests strapping a buoyant body fixed to the front portion of the boot to overturn the ski. By positioning the buoyant body in front of the balance point of the ski, the uprighting mechanism is less effective due to the weight distribution and forward boot placement of current water-skis. A buoyant object positioned in front of the boot would effectively act on the bow of the ski, instead of on the entire ski. The position is also one that causes significant water drag when the skier is being towed by the power boat, partially submerged in the water at the beginning his water-ski and also air drag when planing on the water during the water-ski. U.S. PPA No. 20090061706 relates to attaching a buoyant body to a water board so as to upright an overturned board and encourage entrapment of the wind so as to induce movement downwind. While fallen surfers and kite boarders desire for their detached water board to float downwind towards them, water-skiers desire for the detached water-ski to remain stationary. A common method used to relocate a detached water-ski is to try to remember in what general area the ski detached from the skier so as to improve one's chances of finding the ski more readily. If the ski were moved from its original position, the relocation of the ski would be considerably more difficult.

A need therefore exists for an uprighting method and device that increases the visibility of an unattended floating water-ski or water board, assisting in the relocation of the ski or board by towing boat and the avoidance of the ski or board by other water goers, without encouraging the movement of the ski or board by the wind.

SUMMARY

The object of this invention is to provide a water-ski or water board locator device comprised of a geometrically shaped, buoyant body attached to the water-ski or water board at or near the center of gravity of the ski or board by readily detachable means.

The invention may be of any geometric shape, however it should not extend beyond the width of the ski or board, so as to avoid interference with water flow. It also should vertically protrude high enough above the face of the ski or board so as to separate the center of buoyancy and the center of mass of the assembly, creating a sufficient lever arm to roll the ski or board. A preferred embodiment will be of a generally rectangular shape, spanning nearly the entire width of the ski and extending upward to a height similar to that of the top of the water-ski boot. The device will not protrude unnecessarily above the top of the water-ski boot so as to discourage the entrapment of the wind and the resulting relocation of the ski.

The invention may be comprised of various buoyant materials including, for example, foam or inflatable nylon. The most preferred embodiment is of inflatable rip-stop nylon so as to be durable upon contact with the fast-moving water during detachment, rigid when momentarily submerged, and deflatable for easy storage. Due to the relatively elastic nature of the inflatable device, the safety of the assembly is increased in the event of a collision.

The water-ski or water board locator device detailed in this patent disclosure is specifically designed to be positioned behind the front boot of the water-ski or water board, nearest to the center of gravity of the ski or board. As noted in U.S. Pat. No. 4,871,335, this central positioning is ideal for rolling the ski around its lengthwise axis and therefore allows for minimization of buoyant material.

The device may be attached to the water-ski or water board by any means, however it should be securely fixed during use and readily detachable during non-use. A preferred means of attachment is by use of a rigid base plate protruding outward from under the buoyant device towards the front boot binding. Modern water-ski and water board boot bindings are secured to the top of the water-ski or water board by a series of screws on either side of the boot. The preferred base plate would extend towards the boot so as to be able to be fixed under the stern-most set of binding screws. The device is easily detachable by temporarily unscrewing the two screws and removing the base plate from under the binding. In this embodiment, existing water-ski or water board binding screws and holes are used and therefore no alterations are made to the ski or board. The rigidity of the base plate securely fixes the buoyant material to the ski or board, discouraging the displacement of the device from the face of the ski or board when in contact with the water.

The invention may be of any color or fabric design, however it should maximize the visibility of the device. Bright colors such as yellow, orange or red are most readily visible against the backdrop of open water and sky, which commonly consist of blue, green, brown or grey hues.

DRAWINGS OF A SUITABLE EMBODIMENT

DRAWINGS

Reference Numerals

10 Buoyant material/inflated pouch.
11 Base plate.
12 Boot binding screw of stern set.
13 Hole for screw.
14 Boot.
15 Boot binding.
16 Stern armature of boot binding.
17 Water-ski.

DETAILED DESCRIPTION OF A SUITABLE EMBODIMENT

Description and Operation

Figure 1:
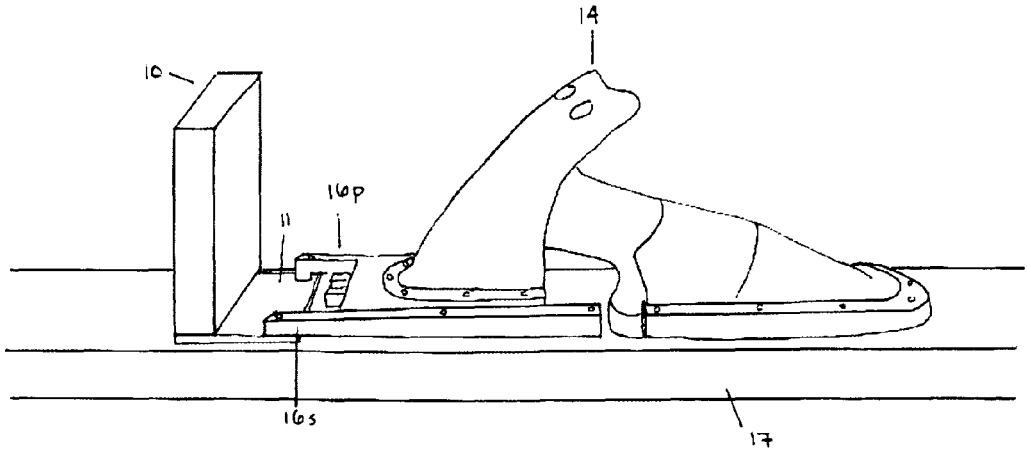
FIG. 1 is a starboard perspective view of the present invention, inflated and mounted on the water-ski.

Referring to FIG. 1, shown is a starboard perspective view of the device in one of its suitable forms, mounted on the water-ski 17, behind the boot 14. The water-ski locating device includes a rectangular, inflated buoyant body 10 similar in height to the heel portion of the boot 14. It also includes a base plate 11 onto which the buoyant body 10 is permanently adhered. The base plate 11 lines the base of the rectangular body 10 and extends, maintaining similar width, forward and underneath the port and starboard stern armatures of the boot binding 16*p* and 16*s*.

Figure 2:
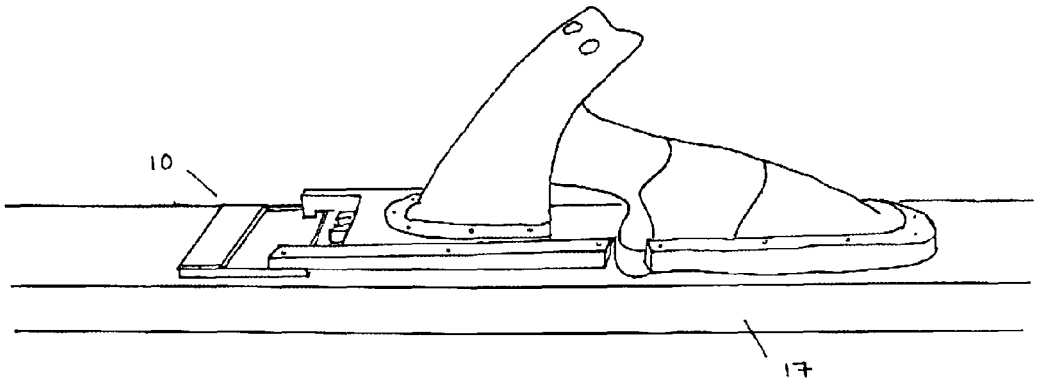
FIG. 2 is a starboard perspective view of the present invention, deflated and mounted on the water-ski.

Referring to FIG. 2, the buoyant body 10 is detailed from the starboard perspective in its deflated form. As shown, the deflated body 10 lays flat on top of the ski 17, allowing for natural storage of the water-ski without removal of the device.

Figure 3:
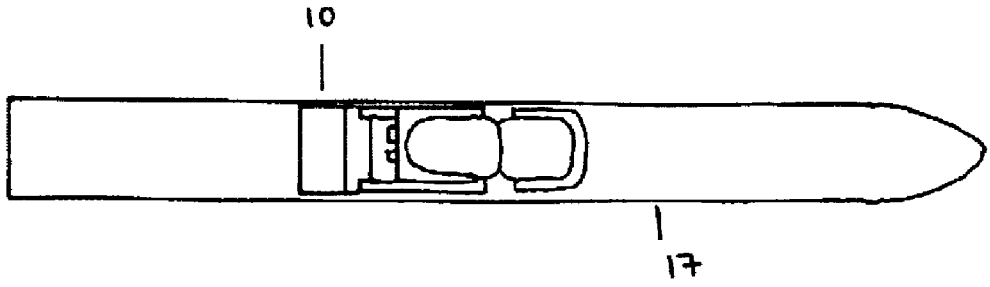
FIG. 3 is a top view of the present invention and the water-ski showing preferred width of the device.

Referring to FIG. 3, the water-ski 17 and device are shown in top view so as to highlight the width of the buoyant body 10 in relation to the width of the water-ski 17.

Figure 4:
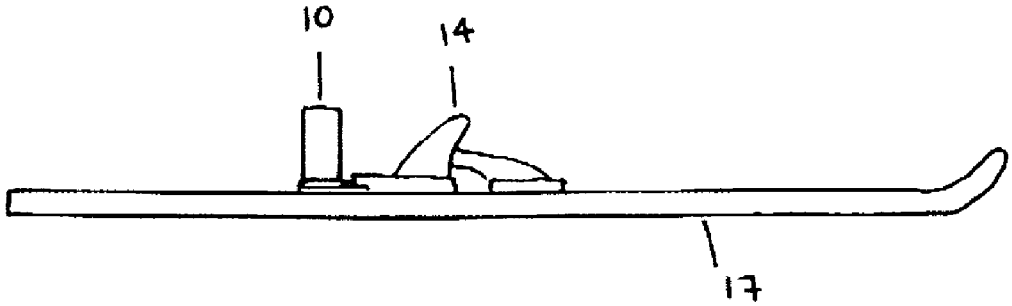
FIG. 4 is a starboard view of the present invention and the water-ski showing preferred height of the device.

Referring to FIG. 4, the water-ski 17 and device are shown in starboard profile view so as to highlight the similarity in height of the boot 14 and buoyant body 10 and to show the relative proportions of the two.

Figure 5:
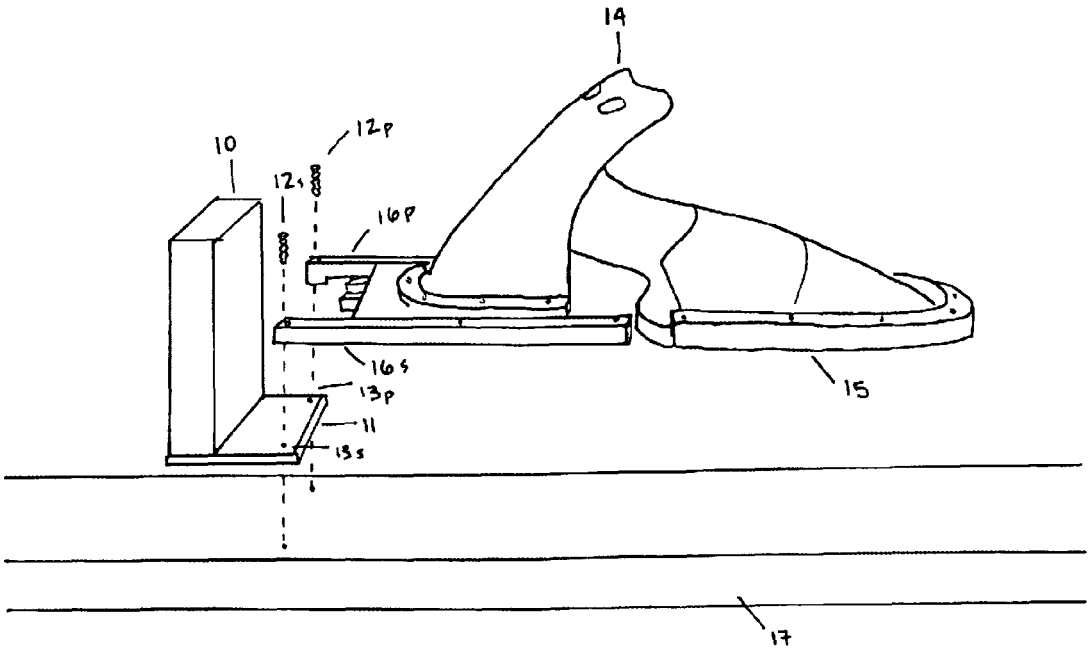
FIG. 5 is an exploded, starboard perspective view of the present invention showing base plate attachment to the water-ski.

Referring to FIG. 5, the boot 14 and binding 15, device, and water-ski 17 are shown in exploded view so as to detail assembly onto the ski. The complete assembly of the invention generally consists of the boot 14 and binding 15 mounted on top of the base plate 11 of the locator device which is subsequently mounted onto the water-ski 17. Only the port and starboard stern armatures of the boot binding 16*p* and 16*s* are in contact with the upper portion of the base plate 11 of the device as the base plate extends underneath the boot binding 15 only as far as needed to be included in the stern set of binding screws 12*p* and 12*s*. Alignment of port and starboard holes 13*p* and 13*s* for the stern set of binding screws is maintained during assembly so as to correctly configure the invention.

Figure 6:
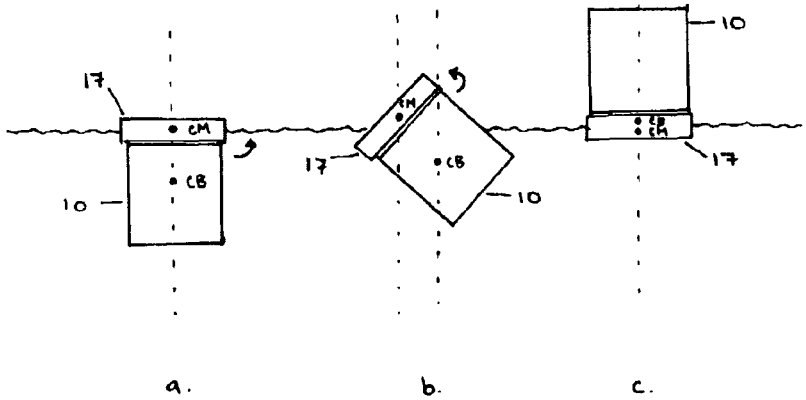
FIG. 6 is a rear view of uprighting motion the present invention mounted on the water-ski.

Referring to FIG. 6, depicts rear views of several hydrostatic states during the uprighting motion of the locator device and the water-ski 17. FIG. 6*a* shows the water-ski 17 in an upside down position where the buoyant body 10 is entirely submerged. Due to the location of the center of mass (CM) above the center of buoyancy (CB), this position is conditionally stable. With a slight displacement due to a wave movement, the offset of the alignment of the center of buoyancy and the center of mass will cause the water-ski to roll along its lengthwise axis. FIG. 6*b* shows a water-ski 17 in the middle of its roll with the buoyant body 10 partially submerged. The center of buoyancy and center of mass are not aligned, therefore the roll is incomplete. FIG. 6*c* shows a water-ski 17 in its upright position with the buoyant body 10 at rest, entirely out of contact with the water. The center of buoyancy rests above and in line with the center of mass, therefore the water-ski is unconditionally stable.

CONCLUSIONS, RAMIFICATIONS AND SCOPE

While the above description contains many specificities, it will be understood that it is capable of further modification and that the above description should not be construed as a limitation on the scope of any embodiment. This application is intended to cover any other variations, uses, or adaptations following, generally, the principles of the invention. Thusly, the scope of the invention should not be determined by the embodiment illustrated, but by the appended claims and their legal equivalents.

| REFERENCES CITED | | |
|---|---|---|
| United States patents | | |
| 3,031,697 | Klein | Sep. 29, 1959 |
| 3,066,326 | Collins | Sep. 3, 1957 |
| 3,212,113 | Barrett | Jan. 24, 1964 |
| 4,026,236 | Robbins | May 31, 1977 |
| 4,871,335 | Grams | Oct. 3, 1989 |
| 5,514,016 | Larson | May 7, 1996 |
| United States Patent Application | | |
| 20090061706 | Myerscough | Mar. 5, 2009 |

What is claimed is:

1. A device for attachment to a water-ski or water board bearing a boot affixed to a substantially planar top surface thereof, wherein the boot has a toe end and a heel end, and wherein a peripheral region of the heel end is affixed to said top surface by at least two screws passing through holes passing through the peripheral region of the heel end and into the top surface of the water-ski or water board, comprising:

A. a buoyant body comprising a hollow collapsible structure adapted to be selectively inflated and deflated with air having at least three substantially planar surfaces, B. a substantially planar rigid base plate fixedly coupled to the planar surface of the buoyant body and including at least a mounting portion extending therefrom, wherein the mounting portion is adapted for insertion between the heel end of a boot and a top surface of a water-ski or water board, and when so positioned, is adapted to receive two screws passing through holes in a peripheral region of a heel end of the boot and through the mounting portion and into the top surface of the water-ski or water board, whereby the base plate is directly fixed to the buoyant body and captively held to the top surface of the water-ski or water board.

2. A device according to claim 1, wherein the relative buoyancy and relative geometry of the buoyant body and the water-ski or water board are such that when the water-ski or water board is floating free in water, the buoyant body is, or transitions to be, higher than the water-ski or water board.

* * * * *